United States Patent [19]

Jeffreys

[11] Patent Number: 4,585,048

[45] Date of Patent: Apr. 29, 1986

[54] MOLD TRANSFER ASSEMBLY

[75] Inventor: Lyman W. Jeffreys, Barrington, Ill.

[73] Assignee: AMSTED Industries Incorporated, Chicago, Ill.

[21] Appl. No.: 514,968

[22] Filed: Jul. 18, 1983

[51] Int. Cl.[4] ..... B22D 5/00

[52] U.S. Cl. ..... 164/323; 164/322

[58] Field of Search ..... 164/129, 130, 322, 323; 414/225, 589, 751; 198/486

[56] References Cited

U.S. PATENT DOCUMENTS

| | | | |
|---|---|---|---|
| 2,847,739 | 8/1958 | Sylvester | 164/119 |
| 2,999,281 | 9/1961 | Drever et al. | 164/267 |
| 3,512,576 | 5/1970 | Plume et al. | 164/323 |

FOREIGN PATENT DOCUMENTS

| | | | |
|---|---|---|---|
| 2047140 | 11/1980 | United Kingdom | 164/323 |

*Primary Examiner*—Nicholas P. Godici
*Assistant Examiner*—Richard K. Seidel
*Attorney, Agent, or Firm*—Charles E. Bouton; Edward J. Brosius

[57] ABSTRACT

A pouring assembly for use in the manufacture of cast metal articles is provided. After a mold is filled with molten metal at a pouring station, it is lifted to a set down station. Simultaneously, an empty mold is lifted from a pick up location to the pouring station. After a hold down mechanism is set on the mold, the mold is filled with molten metal injected upwardly under pressure into the mold and a mold stopper is closed to prevent the molten metal from running out when the injection pressure is relieved.

7 Claims, 2 Drawing Figures

MOLD TRANSFER ASSEMBLY

BACKGROUND OF THE INVENTION

The present invention relates to the production of cast metal articles, and more specifically, to an apparatus and a method for holding a mold that is being filled and for transferring a mold filled with molten metal from a pouring station while moving an empty mold onto said pouring station.

In the manufacture of cast metal articles such as railway wheels, it is important from a cost savings and energy savings point of view to produce such wheels as rapidly as possible while maintaining the accuracy necessary to produce near finish castings. A typical wheel casting plant layout is shown in U.S. Pat. No. 2,999,281. A cope or top mold section is placed on top of a drag or bottom mold section to form a complete mold. Usually the mold is a reusable graphite mold. When the completed mold is moved along a conveyor to a pick up station adjacent the pouring station, a pick-up crane is used to lift the mold and place it on the pouring station above the pouring tank. The mold is located above the pouring tank because a bottom pressure pouring method is used to inject the molten metal into the mold. The ladle containing the molten metal is placed within a pouring tank. The pouring tank is capable of being pressurized with air, thereby forcing the molten metal upwardly through a refractory pouring tube into the bottom of the mold.

Prior to filling the mold, the mold must be held in place, usually by air cylinders which extend downwardly to contact the cope. Further, a mold stopper assembly must be lowered, again by air cylinder, over the stopper hole in the mold. Finally, a riser height control mechanism must be lowered into the mold riser whereby the height of the molten metal in the riser is determined and hence the pouring operation is automatically controlled. These three mechanisms, the hold down cylinders, the mold stopper and the riser height control mechanism, were previously located on the mold set down crane legs used to pick up the filled mold and transfer it to the mold set down location from where the mold would continue for processing along conveyors.

The mold set down crane and the mold pick up crane are each comprised of a column assembly having two legs, and both column assemblies are mounted on a single top frame assembly. Such top frame assembly is capable of lateral movements along secondary girders, which secondary girders themselves comprise a crane assembly mounted on main girders giving the secondary girders the capability of moving longitudinally with relation to the pouring station. Because of the mounting of the pick up crane and set down crane on a single top frame assembly, their lateral movements along the secondary girders are simultaneous and of equal lateral dimension.

In the pouring sequence of the previously known arrangement, a mold just filled with molten metal is at the pouring station and a second, empty mold is at the mold pick up location. The mold hold down assembly, mold stopper and riser height control are attached to the set down crane, and, after pouring is completed, are raised from the mold. The set down crane then raises the filled mold while the pick up crane raises an empty mold. The frame assembly supporting both cranes is moved laterally along the secondary girders. The filled mold is placed at the set down location by the set down crane and the empty mold is placed at the pouring station by the pick up crane. The set down crane and the pick up crane are then moved via their frame assembly laterally along the secondary girders. When the set down crane reaches the pouring station, the mold hold down assembly and riser height control are lowered to the empty mold and the pouring operation begins. The mold stopper is lowered after the mold has been filled.

It is an object of the present invention to provide an improved pouring station mold handling arrangement.

SUMMARY OF THE INVENTION

The present invention provides an improved mold handling system for a bottom pressure casting operation.

In the pouring arrangement of the present invention, a mold filled with molten metal is moved from the pouring station by the set down crane after the mold hold down assembly, the mold stopper and the riser height control are lifted from the mold. The filled mold is moved from the pouring station by the set down crane while an empty mold is moved to the pouring station by the mold pick up crane. However, the mold hold down assembly, the mold stopper and the riser height control are not attached to the set down crane, but rather are attached to the secondary girders. Accordingly, as soon as the empty mold is placed at the pouring station, the mold hold down assembly, the mold stopper and the riser height control can be lowered onto the mold. The pouring operation can begin before the set down crane is returned to the pouring station. The time savings per casting is about 8 seconds, which, in a plant normally producing 1,000 castings in a 24 hour period, can increase production to about 1,100 castings in a 24 hour period, a 10% increase.

In particular, the present invention provides a pouring assembly for use in the manufacture of cast metal articles, said assembly comprising a mold transfer apparatus including a top frame and two sets of depending legs, a bridge structure, said top frame adapted to move along said bridge structure, a pouring tank containing a ladle, said pouring tank being capable of being pressurized to permit the upward pouring of molten metal from the ladle therein, said pouring tank being positioned at a pouring station under said bridge structure, one set of said depending legs of said mold transfer apparatus adapted to move an empty mold from a pick up location to said pouring station, and the second set of depending legs of said mold transfer apparatus adapted to simultaneously move a filled mold from said pouring station to a set down location, said bridge structure including means to hold said mold at said pouring station to permit the empty mold to begin being filled shortly after being positioned at said pouring station.

The present invention also provides a method of producing cast metal articles comprising the steps of moving a mold filled with molten metal from a pouring station to a set down station while simultaneously moving an empty mold from a pick up station to said pouring station.

DESCRIPTION OF THE PREFERRED EMBODIMENT

Figure 1:
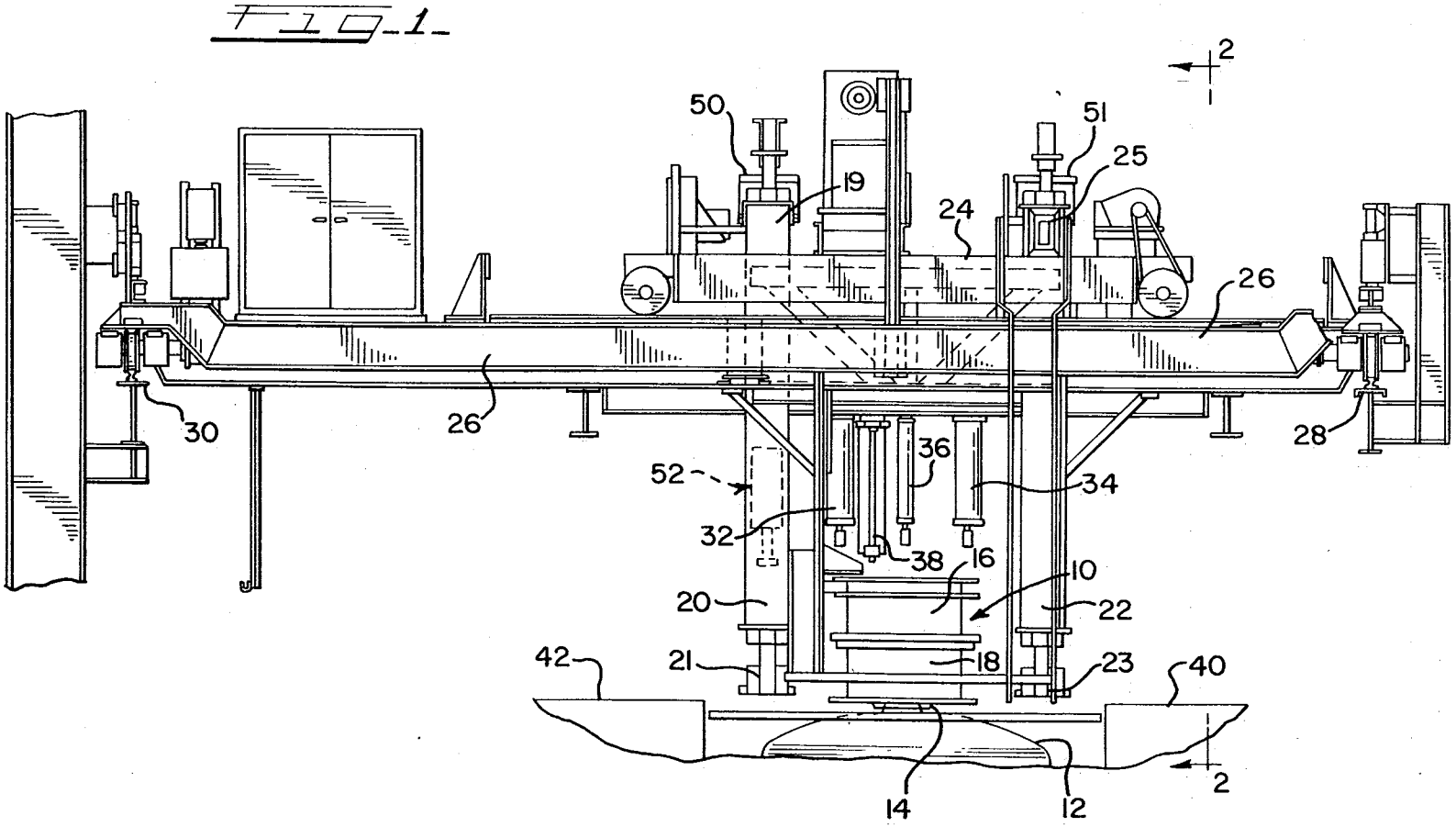
FIG. 1 is a front elevation view of the mold handling system of the present invention.
Figure 2:
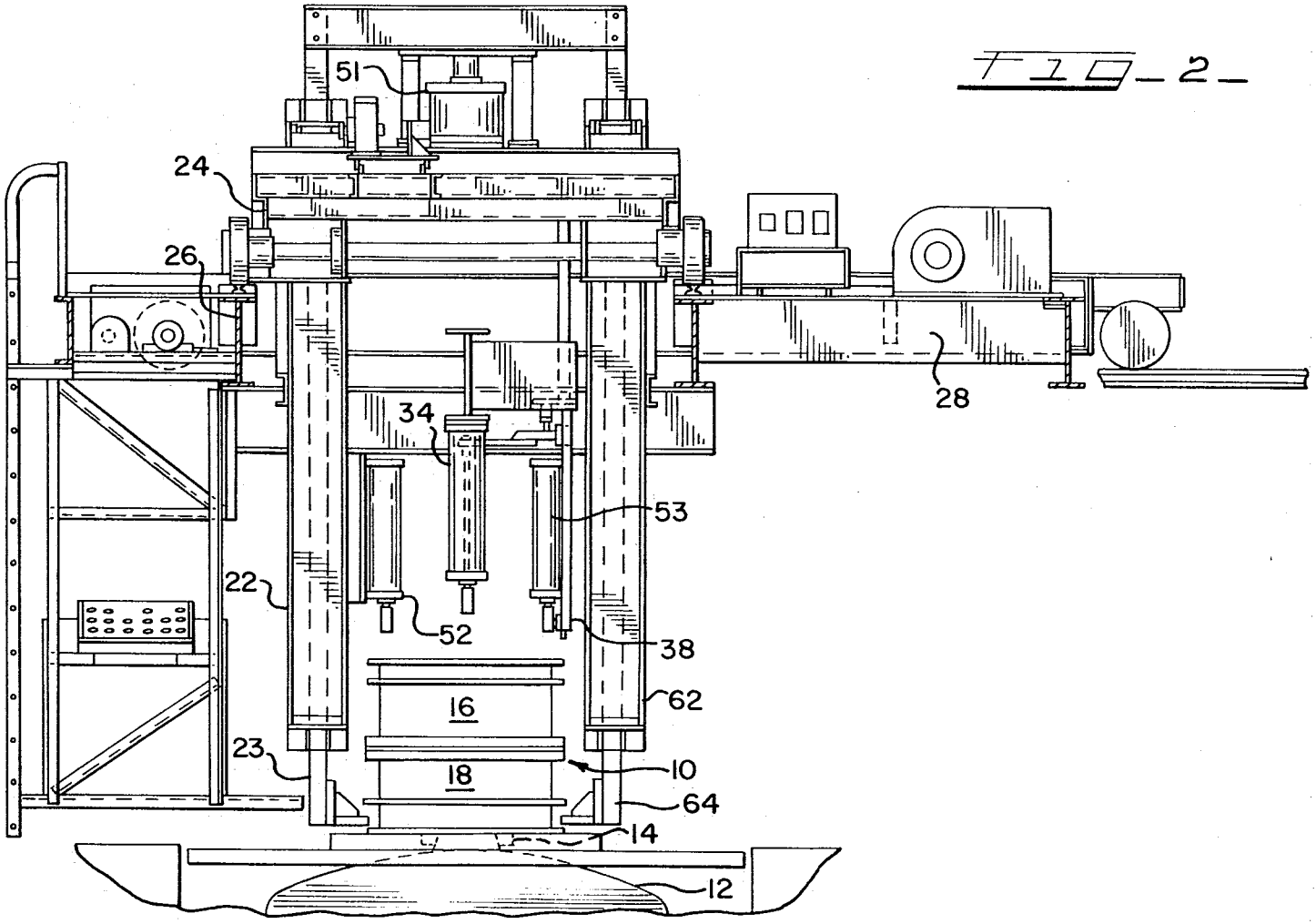
FIG. 2 is a side view along line 2—2 of FIG. 1 of the mold handling system of the present invention.

A pouring station and mold handling system are shown in FIGS. 1 and 2 of the drawings. The mold 10 is centrally located at the pouring station, being set atop pouring tank 12 and joined to pouring tank 12 by refractory pouring tube 14. Mold 10 is comprised of top or cope section 16 and bottom or drag section 18. Usually such molds are of a permanent composition, utilizing compressed graphite as the refractory material.

Set down crane 19 comprises a front depending leg 20 and a rear depending leg (not shown), and pick up crane 25 comprises front depending leg 22 and rear depending leg 62. All said depending legs are supported by top frame assembly 24. Lower section 21 of set down crane front depending leg 20 and a similar lower section of the rear depending leg (not shown), and lower section 23 of pick up crane front depending leg 22 and lower section 64 of rear depending leg 62 are moveable sections supported by compressed air cylinders 50 and 51 within each crane. The pairs of lower section 21 and the lower section of crane 19 not shown and lower sections 23 and 64 of crane 25 cooperate to contact and lift a mold assembly 10. Top frame assembly 24 is a beam arrangement which is adapted to move laterally across a bridge structure formed by a pair of intermediate support girders 26. Girders 26 can move longitudinally across main support rails 28 and 30.

Hanging from intermediate support girders 26 are mold hold down cylinders 32 and 34, usually compressed air type piston cylinders, mold stopper closing mechanism 36, usually also a compressed air type cylinder with a refractory stopper, and riser height control mechanism 38. The refractory stopper is usually mounted in the mold and not connected to the cylinder. Riser height control mechanism 38 can be of various types, but usually extend into the mold riser and, upon the detection of molten metal rising to a preset height, will generate a signal to end the pouring of the molten metal.

Upon the movement of frame assembly 24 to the right in the FIG. 1 set down crane 20 will be aligned with mold 10 at the pouring station. Filled mold 10 will be picked up by set down crane 20. At the same time, pick up crane 22 will be at a mold pick up station 40, where it will pick up an empty mold. As top frame assembly 24 moves left, the filled mold will be set down at the mold set down station 42. At the same time, pick up crane 22 will be setting the empty mold down at the pouring station. Hold down cylinders 32, 34, and riser height control 38 will be lowered to the empty mold, and pouring of molten metal can begin. Mold stopper 36 is lowered after the mold has been filled. Meanwhile, top frame assembly 24 is moving to the right to prepare for the pick up of the filled mold at the pouring station by set down crane 20 and of an empty mold at pick up station 40 by pick up crane 22.

Two secondary hold down cylinders 52 and 53 are attached to set down crane front leg 20 and the rear leg (not shown). These cylinders are usually compressed air type piston cylinders. They are used to hold the full mold closed when being transferred from the pouring station 12 to the set down position 42.

What is claimed is:

1. A pouring assembly for use in the manufacture of cast metal articles, said assembly comprising a mold transfer apparatus including a top frame and two sets of depending legs extending therefrom and supported thereby, a bridge structure, said top frame mounted on said bridge structure so as to be able to move along said bridge structure, a pouring tank containing a ladle, said pouring tank being capable of being pressurized to permit the upward pouring of molten metal from the ladle therein, said pouring tank being positioned at a pouring station under said bridge structure, one set of said depending legs of said mold transfer apparatus adapted to move an empty mold from a pick up location to said pouring station, and the second set of depending legs of said mold transfer apparatus adapted to simultaneously move a filled mold from said pouring station to a set down location, said bridge structure having fixed thereto a holding means to hold said mold at said pouring station to permit the empty mold to begin being filled shortly after being positioned at said pouring station.

2. The pouring assembly of claim 1 wherein said bridge structure further has fixed thereto adjacent said holding means a mold stopper closing mechanism.

3. The pouring assembly of claim 2 wherein said mold stopper closing mechanism is mounted on an air cylinder that extends downwardly to contact said mold.

4. The pouring assembly of claim 1 wherein said bridge structure further has fixed thereto adjacent said holding means a riser molten metal height control mechanism.

5. The pouring assembly of claim 1 wherein each said set of depending legs includes a lifting cylinder that enables each set of legs to lift a mold.

6. The pouring assembly of claim 1 wherein said holding means to hold said mold at said pouring station includes two air cylinders that extend downwardly to contact said mold.

7. The pouring assembly of claim 1 wherein said depending legs adapted to move a full mold to the set down location have secondary hold down air cylinders adapted to hold a full mold closed during transfer.

* * * * *